US007119752B2

(12) United States Patent
Matsui et al.

(10) Patent No.: US 7,119,752 B2
(45) Date of Patent: Oct. 10, 2006

(54) ANTENNA UNIT

(75) Inventors: Hiroyasu Matsui, Kanagawa (JP); Susumu Chonan, Kanagawa (JP); Takeshi Kunii, Tokyo (JP)

(73) Assignee: Clarion Co., Ltd., Tokyo (JP)

( * ) Notice: Subject to any disclaimer, the term of this patent is extended or adjusted under 35 U.S.C. 154(b) by 0 days.

(21) Appl. No.: 11/038,462

(22) Filed: Jan. 21, 2005

(65) Prior Publication Data

US 2005/0179603 A1 Aug. 18, 2005

(30) Foreign Application Priority Data

Jan. 22, 2004 (JP) ..... P2004-014027

(51) Int. Cl.
*H01Q 1/38* (2006.01)
*H01Q 21/00* (2006.01)
*H01Q 1/32* (2006.01)

(52) U.S. Cl. ..... 343/725; 343/700 MS; 343/715

(58) Field of Classification Search ..... 343/711, 343/713, 715, 700 MS, 725
See application file for complete search history.

(56) References Cited

U.S. PATENT DOCUMENTS 5,610,620 A * 3/1997 Stites et al. ..... 343/725
5,831,577 A * 11/1998 Nichols et al. ..... 342/357.03
6,298,243 B1 * 10/2001 Basile ..... 455/552.1
6,927,743 B1 * 8/2005 Miller et al. ..... 343/872

FOREIGN PATENT DOCUMENTS

| | | | |
|---|---|---|---|
| EP | 0 862 239 A1 | | 9/1998 |
| EP | 1 187 253 A1 | | 3/2002 |
| EP | 1 286 414 A1 | | 2/2003 |
| JP | 0747993 | * | 11/1996 |
| JP | 2000-124722 | | 4/2000 |
| JP | 2002-329541 | | 11/2002 |

OTHER PUBLICATIONS

European Search Report dated Apr. 28, 2005.

* cited by examiner

*Primary Examiner*—Shih-Chao Chen
(74) *Attorney, Agent, or Firm*—McGinn IP Law Group PLLC

(57) ABSTRACT

The antenna unit including a first antenna portion including a first element, a first board for mounting the first element, and a feeding conductor for electrically connecting the first element and the first board and capable of receiving a radio wave in a first frequency band, and a second antenna portion including a second element shorter than the first element, and a second board for mounting the second element and capable of receiving a radio wave of a second frequency band higher than the first frequency band, in which a length of a transmitting path of the feeding conductor and a length of the second element are formed to configure lengths different from each other.

22 Claims, 3 Drawing Sheets

ANTENNA UNIT

BACKGROUND OF THE INVENTION

1. Field of the Invention

The present invention relates to an antenna unit having a plurality of antenna portions capable of receiving radio waves of frequency bands different from each other.

2. Description of the Related Art

In a conventional art, a rod antenna for receiving AM/FM radio waves is attached to a circuit board for functioning the antenna via an attaching member having conductivity. Up to the present date, in such a configuration, there has been proposed various antenna structures for achieving further excellent performance (for example, JP-A-2000-124722). According to JP-A-2000-124722, an antenna unit is configured by inserting an attaching member to a circuit board in a state of being brought into contact with a rod antenna.

In recent years, it is conceived to execute transmission and reception using various radio waves other than AM/FM radio waves in, for example, a vehicle-mounted apparatus and in accordance therewith, there are also needed plural kinds of antenna elements provided at the vehicle-mounted apparatus. According to the transmission and reception using radio waves, mentioned here, there are reception of GPS radio wave used for a navigation apparatus, data transmission and reception in an ETC apparatus, transmission and reception in satellite broadcast, and transmission and reception of data by Bluetooth (registered trade mark) standard, some of them are being used, and with regard to some of them, research and development for practical use had been carried out. Frequencies of the radio waves are higher than those of AM/FM radio waves and therefore, elements for receiving the radio waves are shorter than that of the above-described rod antenna.

SUMMARY OF THE INVENTION

An antenna unit provided at a vehicle-mounted apparatus is generally used by being attached to outside of a vehicle for excellently receiving radio waves. However, an outer shape of a structure attached to outside of a vehicle is restricted in conformity with regulations. Therefore, such an antenna unit is requested to be formed as small as possible. Particularly, the restriction is severe in a direction of being projected from the vehicle and therefore, when a plurality of elements are installed, the respective elements cannot be arranged by being laminated in the projecting direction, and are necessarily arranged in parallel with each other. In this occasion, when a length of the attaching member in the projecting direction is pertinently designed to substantially coincide with a length of an element for a high frequency in the direction defined by a receiving band, a position of arranging the rod antenna can be lowered and an amount of projecting the antenna unit can be restrained.

However, when the element for the high frequency is arranged as described above in order to achieve small-sized formation of the antenna unit, there is a case in which a gain of the element for the high frequency is reduced.

Hence, in view of the above-described situation, it is an object of the invention to provide an antenna unit capable of alleviating a reduction in a gain of an element for a high frequency while restraining an amount of projecting the element from a vehicle.

According to an embodiment of the invention resolving the above-described problem, there is provided an antenna unit including: a first antenna portion capable of receiving a radio wave in a first frequency band, the first antenna portion including: a first element; a first board for mounting the first element; and a feeding conductor for electrically connecting the first element and the first board, and a second antenna portion capable of receiving a radio wave of a second frequency band higher than the first frequency band, the second antenna portion including: a second element shorter than the first element; and a second board for mounting the second element, wherein a length of a transmitting path of the feeding conductor and a length of the second element are configured to different from each other. Therefore, the feeding conductor is made to be difficult to function as an element having a function similar to that of the second element, as a result, the radio wave of the second frequency band is made to be able to be received by the second element further excellently. Therefore, a reduction in a gain of the second element is alleviated.

Further, the antenna unit may be configured by a configuration in which the length of the transmitting path of the feeding conductor is made to be longer than the length of the second element.

Further, the antenna unit may be configured by a configuration in which the feeding conductor is configured by a meandering structure or a slot structure.

Further, the antenna unit may be configured by a configuration in which the first frequency band includes frequency bands of AM/FM radio waves. Further, the second frequency band may include a frequency band of a radio wave of satellite broadcast.

Further, an antenna unit according to another embodiment of the invention resolving the above-described problem, there is provided an antenna unit including: a first antenna portion capable of receiving a radio wave of a first frequency band, the first antenna portion including a first element; a second antenna portion capable of receiving a radio wave of a second frequency band higher than the first frequency band, the second antenna portion including a second element shorter than the first element; and a board for mounting the first element and the second element, wherein the first antenna portion further includes a feeding conductor for electrically connecting the first element and the board, and the feeding conductor is configured such that a length of a transmitting path thereof differs from a length of the second element.

According to the antenna unit of the invention, by forming a length of at least a portion of the transmitting path of the feeding conductor and the length of the second element by the lengths different from each other, the feeding conductor is made to be difficult to function as an element having a function similar to that of the second element. Therefore, the radio wave of the second frequency band is made to be difficult to be received by the feeding conductor, and is made to be able to be received by the second element further excellently. As a result, the reduction in the gain of the second element is alleviated.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

An antenna unit 100 according to a first embodiment of the invention is a unit provided at a vehicle-mounted apparatus mounted to a vehicle and is a compound antenna provided with both a function of receiving AM/FM radio broadcast and a function of receiving a satellite radio broadcast.

The antenna unit 100 is used by being attached to outside of a vehicle in order to excellently receive various radio waves. As described above, a structure attached to outside of a vehicle is requested to be small-sized and therefore, the antenna unit 100 is devised to excellently receive various radio waves in a state of downsizing a shape thereof.

Figure 1:
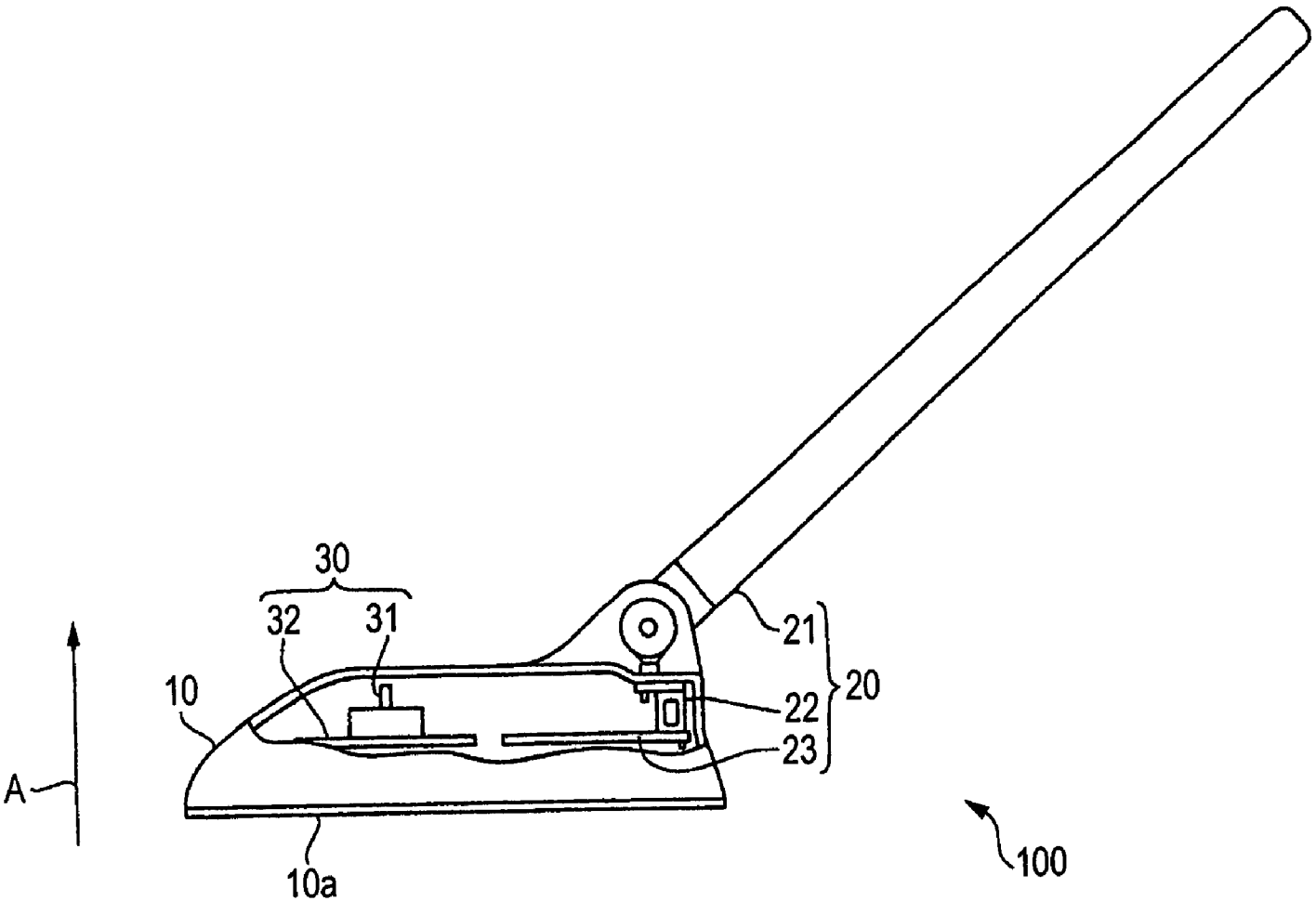
FIG. 1 is a sectional view showing a sectional shape of an antenna unit according to a first embodiment of the invention.
Figure 2:
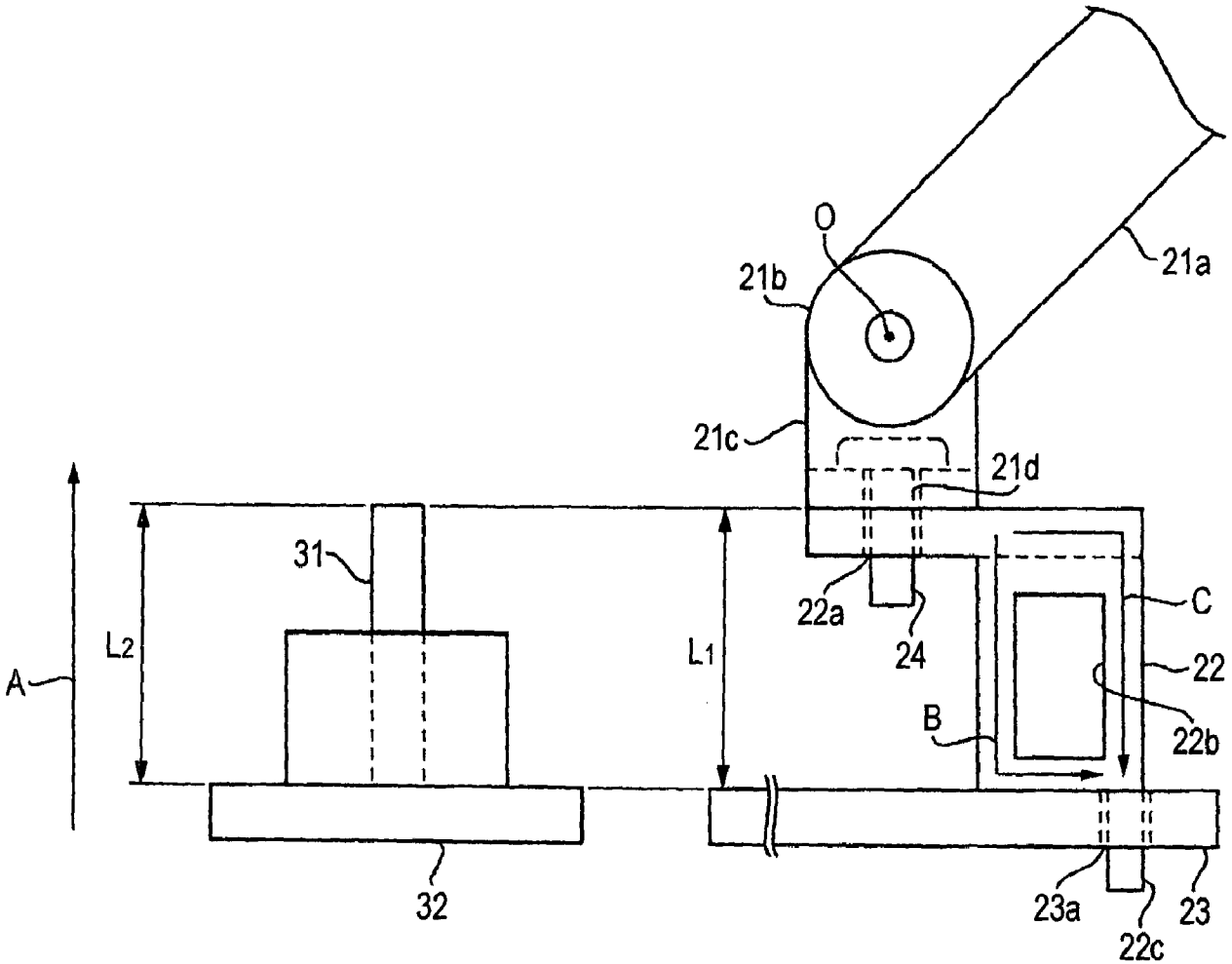
FIG. 2 is a principal enlarged view showing to enlarge a principal configuration at inside of the antenna unit according to the first embodiment of the invention.

FIG. 1 is a sectional view showing a sectional shape of the antenna unit 100 according to the first embodiment of the invention. Further, FIG. 2 is a principal enlarged view showing to enlarge principal configurations at inside of the antenna unit 100 according to the first embodiment of the invention. An arrow mark A direction of FIG. 1 is a direction of projecting from a vehicle, and the antenna unit 100 is configured to minimize an amount of projecting in the direction. Configuration and operation of the antenna unit 100 will be explained in reference to FIG. 1 and FIG. 2 as follows.

As shown by FIG. 1, the antenna unit 100 includes an antenna base 10 for housing various parts, a first antenna portion 20 for receiving AM/FM radio broadcast, and a second antenna portion 30 for receiving satellite radio broadcast having a frequency band higher than that of AM/FM radio broadcast. The antenna base 10 is grounded to a panel face of a vehicle by a ground face 10*a* while housing the first antenna portion 20 and the second antenna portion 30 at inside thereof, and is fixed to a vehicle.

As shown in FIG. 1 and FIG. 2, the first antenna portion 20 includes a rod antenna 21, an attaching member 22, a circuit board 23 and an attaching screw 24.

The rod antenna 21 is an element having a well-known retractable structure and includes an element 21*a* for receiving AM/FM radio waves, a pivoting portion 21*b* pivottably supporting the element 21*a* at a pivoting center O, a contact portion 21*c* brought into contact with the attaching member 22, and a hole portion 21*d* provided at the contact portion 21*c*. Further, according to other embodiment, the rod antenna 21 may be replaced by an element which is not retractable.

Further, the attaching member 22 is a hardware member having conductivity formed by pressing one sheet of metal to further subject to bending. The attaching member 22 functions as an intermediate member of the rod antenna 21 and the circuit board 23 and achieves a function of transmitting a signal transmitted from a side of the rod antenna 21 to a side of the circuit board 23 (function as a feeding conductor). The attaching member 22 includes a face in a direction orthogonal to paper face of FIG. 2, and the face is formed with a hole portion 22*a* having a diameter the same as that of the hole portion 21*d* of the rod antenna 21. Further, the attaching member 22 includes a face in a direction in parallel with the paper face of FIG. 2, and the face is formed with a hole portion 22*b* in a rectangular shape. By forming the hole portion 22*b*, the attaching member 22 is formed as if it were a slot structure with regard to the face. Further, an inserting portion 22*c* projected slenderly is formed at an end portion on the face in a horizontal direction and on a side opposed to the hole portion 22*a* by interposing the hole portion 22*b*.

The rod antenna 21 and the attaching member 22 are brought into a state of being brought into contact with each other and brought into a state of being connected with each other electrically by the hole portion 21*d* and the attaching screw 24 screwed to the hole portion 22*a*. Further, the rod antenna 21 and the attaching member 22 may electrically be connected with each other by soldering.

The circuit board 23 is a board mounted with various elements including the rod antenna 21. The circuit board 23 includes a through hole 23*a*, an inner wall of which is provided with conductivity. The attaching member 22 and the circuit board 23 are brought into a state of being brought into contact with each other and brought into a state of being connected with each other electrically by inserting the inserting portion 22*c* of the attaching member 22 to the through hole 23*a*. Further, a distance in the arrow mark A direction from the above-described face at which the attaching member 22 is brought into contact with the rod antenna 21 to a position at which the attaching member 22 is brought into contact with the circuit board 23 is designated by notation $L_1$.

As shown in FIG. 1 and FIG. 2, the second antenna portion 30 includes an element 31 and a circuit board 32. Since the second antenna portion 30 is an antenna for receiving satellite radio broadcast, the element 31 configuring a receiving medium is formed to be shorter than the element 21*a* for receiving AM/FM radio broadcast. As shown in FIG. 2, the element 31 is provided with a length $L_2$ in the arrow mark A direction.

According to the embodiment, in order to restrain an amount of projecting the antenna unit 100 (further specifically, the antenna base 10) in the arrow mark A direction, the circuit board 23 of the first antenna portion 20 and the circuit board 32 of the second antenna portion 30 are arranged at vicinities of the ground face 10*a* of the antenna base 10 and on substantially the same plane with each other. Further, a length of the element 31 is defined by a receiving frequency band and therefore, a position of an upper face of the antenna base 10 is determined by the length of the element 31 to minimize the length.

At this occasion, when the attaching member 22 is formed to be longer than the element 31 in the arrow mark A direction, a portion of projecting the antenna base 10 for housing the first antenna portion 20 is enlarged, in accordance therewith, also the position of the rod antenna 21 is raised. As a result, the antenna unit 100 becomes large-sized.

Further, when the attaching member 22 is formed to be shorter than the element 31 in the arrow mark A direction, a radio wave transmitted from a side opposed to the element 31 interposing the antenna portion 20 is liable to be cut by the first antenna portion 20, as a result, there is a concern of reducing a gain of the second antenna portion 30.

Further, when the length $L_1$ of the attaching member 22 is designed to be a length substantially equivalent to the length $L_2$ of the element 31, the attaching member 22 functions as an element similar to the element 31, a portion of a radio wave all of which is to be received by the element 31 inherently is received by the attaching member 22, as a result, there is a case of reducing the gain of the second antenna portion 30.

To achieve downsizing a size of a unit, the antenna unit 100 according to the first embodiment of the invention employs a design configuring the length $L_1$ of the attaching member 22 and the length $L_2$ of the element 31 by substantially equivalent lengths with respect to the arrow mark A direction. Further, in order to solve the above-described concern conceived in this case, by forming the hole portion

22*b* in the rectangular shape at a center portion of the face of the attaching member 22 in the horizontal direction, a path of transmitting the radio wave in the attaching member 22 which is transmitted from the rod antenna 21 to the circuit board 23 is prolonged. Further, in order to restrain an amount of projecting the antenna unit 100 in attaching to the vehicle (that is, to downsize the unit 100), it is necessary to configure the antenna unit 100 to be able to make the rod antenna 21 fall to a direction in parallel with a surface of the vehicle. In this case, when the attaching member 22 and the element 31 are formed to configure $L_1$ and $L_2$ by substantially the equivalent lengths, an upper face of the antenna base 10 (that is, face opposed to the ground face 10*a*) can be formed in a direction orthogonal to the arrow mark A direction. Therefore, the rod antenna 21 can be made to fall to a degree of being brought into contact with the upper face of the antenna 10 (that is, direction in parallel with the surface of the vehicle) and the amount of projecting the unit 100 can be restrained as a whole.

By forming the hole portion 22*b* at the attaching member 22, the transmitting path becomes a path B or path C shown in FIG. 2. The path B and the path C are configured by adding a width of the attaching member 22 (in direction orthogonal to the arrow mark A direction) to the length $L_1$ and therefore, the transmitting path becomes longer than the length $L_2$ of the element 31. Therefore, even in the case in which the attaching member 22 functions as the element when the element 31 is receiving the radio wave, since the transmitting path is longer than the length $L_2$ of the element 31, the attaching member 22 is made to be difficult to achieve a function as if the attaching member 22 were the element 31. Therefore, the second antenna portion 30 can excellently receive the radio wave, as a result, a reduction in the gain of the second antenna portion 30 is alleviated.

Figure 3:
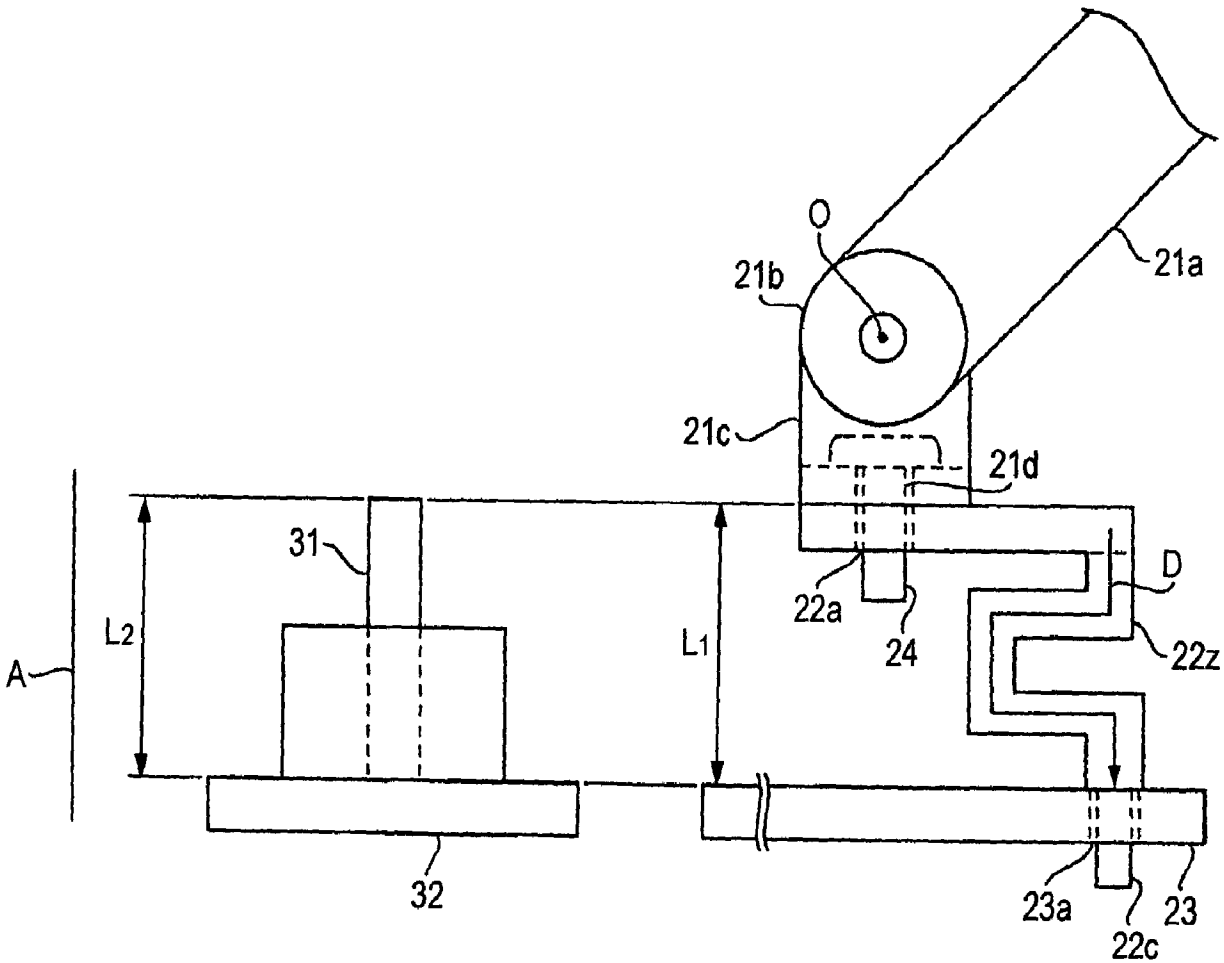
FIG. 3 is a principal enlarged view showing to enlarge a principal configuration at inside of an antenna unit according to a second embodiment of the invention.

FIG. 3 is a principal enlarged view showing to enlarge a principal configuration at inside of an antenna unit according to a second embodiment of the invention. Further, in an antenna unit according to the second embodiment, configurations which are the same as those of the antenna unit 100 according to the first embodiment shown in FIG. 2 are attached with the same notations and a detailed explanation thereof will be omitted here.

According to the antenna unit of the second embodiment, the first antenna portion 20 includes the rod antenna 21, an attaching member 22*z*, the circuit board 23 and the attaching screw 24.

The attaching member 22*z* includes the hole portion 22*a* and the inserting portion 22*c* similar to those of the attaching member 22 of the first embodiment, and thereby, the rod antenna 21 and the circuit board 23 are brought into the state of being connected to each other electrically. Further, the attaching member 22*z* is provided with a detoured shape as shown in FIG. 3 with regard to a face thereof in parallel with paper face of FIG. 3. In other words, the attaching member 22*z* is formed as a member having a meandering structure with regard to the face in parallel with a paper face of FIG. 3.

The attaching member 22*z* is provided with the length $L_1$ which is a length substantially equivalent to the length $L_2$ of the element 31 in the arrow mark A direction by reason similar to that of the attaching member 22 according to the first embodiment. However, since the attaching member 22*z* is provided with the meandering structure as described above, a transmitting path D of a signal in the attaching member 22*z* transmitted from the rod antenna 21 to the circuit board 23 becomes longer than the length $L_2$ of the element 31. Further in details, the transmitting path D is configured by adding a width of reciprocating the attaching member 22 (in direction orthogonal to the arrow mark A direction) to the length $L_1$.

As described above, according to the antenna unit of the second embodiment, the path of transmitting the signal in the attaching member 22*z* is made to be longer than that of the first embodiment and therefore, the second antenna portion 30 can receive the radio wave further excellently.

The above-described is the embodiments of the invention. The invention is not limited to the embodiments but can be modified in various ranges.

Further, although according to the embodiments, the first antenna portion 20 is the antenna for receiving AM/FM radio broadcast and the second antenna portion 30 is the antenna for receiving satellite radio broadcast, the invention is not limited thereto. For example, the first antenna portion 20 may be an antenna for receiving television broadcast. Further, the second antenna portion 30 may be an antenna for receiving a GPS signal, may be an antenna for transmitting and receiving data of ETC, may be an antenna in conformity with the standard of Bluetooth, or may be an antenna for transmitting and receiving data of a portable telephone.

Further, although according to the embodiments, the antennas provided to the antenna unit are two antennas of the first antenna portion 20 and the second antenna portion 30, a larger number of antennas may be provided in an antenna unit according to other embodiment. Also in this case, a reduction in a gain of an element for a high frequency can be alleviated by dealing therewith similar to the embodiments.

Further, although according to the embodiments, the circuit board 23 mounted with the rod antenna 21 and the circuit board 32 mounted with the element 31 are configured by separate boards, the two sheets of circuit boards may be configured by one sheet of circuit board. Thereby, a number of parts can be reduced and therefore, a reduction in integrating steps and a reduction in cost can be achieved.

Further, an effect similar to those of the embodiments can naturally be achieved even when the path of transmitting the radio wave in the attaching member is prolonged by a structure other than the slot structure or the meandering structure.

Further, although according to the embodiments, the attaching member 22 is formed such that the length of the transmitting path is made to be longer than the length of the element 31, the antenna unit 100 may be configured such that the length of the transmitting path of the attaching member 22 is made to be shorter according to other embodiment. In this case, the attaching member 22 in which the length of the transmitting path is not influenced by the frequency band received by the antenna unit 100 may be formed to be shorter than the element 31 and also a shape thereof may be linear.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An antenna unit comprising:

a first antenna portion capable of receiving a radio wave in a first frequency band, the first antenna portion including:

a first element;

a first board for mounting the first element; and a feeding conductor for electrically connecting the first element and the first board, and a second antenna portion capable of receiving a radio wave of a second frequency band higher than the first frequency band, the second antenna portion including:

a second element shorter than the first element; and a second board for mounting the second element, wherein the first board and the second board are arranged on substantially the same plane with respect to each other, and wherein a length of a transmitting path of the feeding conductor and a length of the second element are configured to be different from each other.

2. The antenna unit according to claim 1, wherein the length of the transmitting path of the feeding conductor is configured to be longer than the length of the second element.

3. The antenna unit according to claim 1, wherein the feeding conductor comprises a meandering structure.

4. The antenna unit according to claim 1, wherein the feeding conductor comprises a slot structure.

5. The antenna unit according to claim 1, wherein the first frequency band includes frequency bands of AM/FM radio waves.

6. The antenna unit according to claim 1, wherein the second frequency band includes a frequency band of a radio wave of satellite broadcast.

7. The antenna unit according to claim 1, wherein the length of the second element from the second board is substantially equal to a length of the feeding conductor from the first board.

8. The antenna unit according to claim 1, wherein the second antenna portion connected directly to the second board.

9. The antenna unit according to claim 1, wherein the feeding conductor comprises a component in a horizontal and a vertical direction.

10. The antenna unit according to claim 9, wherein a length of the feeding conductor comprises a sum of components in the horizontal and vertical directions.

11. The antenna unit according to claim 9, wherein the feeding conductor comprises a portion orthogonal to a direction defined by a length of the feeding conductor from the first board.

12. The antenna unit according to claim 1, further comprising:

an antenna mounting base, wherein the first board and the second board are attached to the antenna mounting base.

13. An antenna unit comprising:

a first antenna portion capable of receiving a radio wave of a first frequency band, the first antenna portion including a first element;

a second antenna portion capable of receiving a radio wave of a second frequency band higher than the first frequency band, the second antenna portion including a second element shorter than the first element; and a board for mounting the first element and the second element, wherein the first antenna portion further includes a feeding conductor for electrically connecting the first element and the board, and the feeding conductor is configured such that a length of a transmitting path thereof differs from a length of the second element.

14. The antenna unit according to claim 13, wherein the length of the second element from the board is substantially equal to a length of the feeding conductor from the board.

15. The antenna unit according to claim 13, wherein the second antenna portion is connected directly on the board.

16. The antenna unit according to claim 13, wherein the feeding conductor comprises a component in a horizontal and a vertical direction.

17. The antenna unit according to claim 16, wherein the length of the feeding conductor comprises a sum of components in the horizontal and vertical directions.

18. The antenna unit according to claim 13, further comprising:

an antenna mounting base, wherein the board is attached to the antenna mounting base.

19. An antenna unit comprising:

first means for receiving a radio wave of a first frequency band;

second means for receiving a radio wave of a second frequency band higher than the first frequency band;

means for connecting and supporting the first means and the second means thereto; and means for electrically connecting the first means to the means for connecting and supporting, wherein a length of a transmitting path of the means for electrically connecting is greater than a length of the second means.

20. The antenna unit according to claim 19, wherein a height of the second means from the means for connecting and supporting is substantially equal to a height of the means for electrically connecting from the means for connecting and supporting.

21. An antenna unit comprising:

a first antenna portion capable of receiving a radio wave in a first frequency band, the first antenna portion including:

a first element;

a first board for mounting the first element; and a feeding conductor comprising a meandering structure for electrically connecting the first element and the first board, and a second antenna portion capable of receiving a radio wave of a second frequency band higher than the first frequency band, the second antenna portion including:

a second element shorter than the first element; and a second board for mounting the second element, wherein a length of a transmitting path of the feeding conductor and a length of the second element are configured to be different from each other.

22. An antenna unit comprising:

a first antenna portion capable of receiving a radio wave in a first frequency band, the first antenna portion including:

a first element;

a first board for mounting the first element; and a feeding conductor comprising a slot structure for electrically connecting the first element and the first board, and a second antenna portion capable of receiving a radio wave of a second frequency band higher than the first frequency band, the second antenna portion including:

a second element shorter than the first element; and a second board for mounting the second element, wherein a length of a transmitting path of the feeding conductor and a length of the second element are configured to be different from each other.

* * * * *